United States Patent [19]

Lam

[11] Patent Number: 4,479,358

[45] **Date of Patent: * Oct. 30, 1984**

[54] MINIATURE CRYOGENIC COOLING SYSTEM WITH SPLIT-PHASE DUAL COMPRESSOR AND PHASE-SHIFTING DEVICE

[75] Inventor: Calvin K. Lam, Bedford, N.H.

[73] Assignee: Kryovacs Scientific Corp.

[ * ] Notice: The portion of the term of this patent subsequent to May 31, 2000 has been disclaimed.

[21] Appl. No.: 498,866

[22] Filed: May 27, 1983

Related U.S. Application Data

[63] Continuation-in-part of Ser. No. 358,626, Mar. 16, 1982, Pat. No. 4,385,499.

[51] Int. Cl.[3] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,523,427 | 8/1970 | Simpson | 62/6 |
| 3,851,173 | 11/1974 | Taylor et al. | 250/332 |
| 3,991,586 | 11/1976 | Acord | 62/6 |
| 4,078,389 | 3/1978 | Bamberg | 62/6 |
| 4,090,859 | 5/1978 | Hanson | 62/6 |
| 4,092,833 | 6/1978 | Durenec | 62/6 |
| 4,206,609 | 6/1980 | Durenec | 62/6 |

*Primary Examiner*—Ronald C. Capossela
*Attorney, Agent, or Firm*—Kenway & Jenney

[57] ABSTRACT

A miniature cryogenic cooling system having low microphonics and thermophonics. The apparatus includes a cold finger incorporating primary and secondary working volumes and their associated regenerative beds. Both volumes are adapted to effect cooling. A displacer reciprocates within the cold finger under the influence of push-pull pressure waves from a dual compressor assembly. The cold finger includes an arrangement for providing pneumatic cushioning of the reciprocating displacer to control displacer slamming.

15 Claims, 9 Drawing Figures

MINIATURE CRYOGENIC COOLING SYSTEM WITH SPLIT-PHASE DUAL COMPRESSOR AND PHASE-SHIFTING DEVICE

This is a continuation-in-part of U.S. patent application Ser. No. 358,626, filed Mar. 16, 1982, now U.S. Pat. No. 4,385,499, issued May 31, 1983.

BACKGROUND OF THE INVENTION

This invention relates in general to cryogenic cooling systems and more particularly to a miniature dual-split cryogenic system with the compressor section separated from the cooling section.

Miniature cryogenic cooling systems are known and widely used to cool crystals used as radiation detectors. Cooling to cryogenic temperatures reduces the crystal lattice vibrations so as to improve the signal to noise ratio. A particularly important application for such miniature cryogenic coolers is in the cooling of infrared detectors for use in night vision or heat seeking devices. These systems are also useful for medical applications where it is desired to destroy tissue by means of freezing. Although the requirements for such miniature cryogenic systems will vary depending on the end use of the cooler, typical design considerations are their operating efficiency, durability, compactness, weight, microphonics characteristics (generally vibrations resulting from the compressor motor, vibrations within the working fluid, or the physical impact of moving components in the system), and thermophonics (which is noise resulting from thermogradients within the system). For applications involving infrared sensors for airborne devices, all of these design considerations are important.

Known cryogenic cooling systems fall into several categories. In one type the compressor and expander units form an integral system operating on the stirling cycle. Because of the proximity of the compressor and expander sections, such integral systems are particularly susceptible to the effects of microphonics or mechanical vibrations. The systems also tend to be relatively heavy and have typical operating lives of only 300–500 hours. Thus, integral systems are not particularly effective especially for use in airborne systems.

As a way of isolating the compressor vibration from the expander (known as the "cold finger"), split stirling devices are known which separate the compressor system from the cold finger by conduits carrying the working fluid. A typical design problem with such split systems is the acoustic noise generated by an oscillating displacer which is continually being accelerated and decelerated as it oscillates within the cold finger. Such noise is particularly troublesome in single split stirling systems in which but a single conduit extends from a single compressor to the expander.

Dual-split systems have also been developed in an effort to overcome problems in controlling the motion of the displacer so as to minimize microphonics. In such systems two conduits extend from two separate compressors to the expander. In general the pressure waves in each of the conduits are out of phase with one another so that a push-pull arrangement is effected. That is, in such a system the displacer is moved by alternately introducing high pressure on one side and a lower pressure on the other so as to reciprocate the displacer element. One such dual split cooler is disclosed by Durenec in U.S. Pat. No. 4,092,833. The Durenec system employs a compressor with pistons opposed at a 180 degree angle. In this system, however, the compressor pistons are of different areas so that the pressure waves in the individual conduits are of different magnitudes. In addition, there is no suggestion in the Durenec patent of using the split phase relationship to decelerate and reverse the direction of motion of the displacer in a way to prevent contact of the displacer with the walls of the housing. Such contact with the housing or "slamming" not only causes additional microphonics but also audible acoustic noise. Furthermore this Durenec reference neither teaches nor suggests using the cooling effects of a second working volume to precool the working fluid destined for the main working volume at the tip of the cold finger. In addition, the known split phase coolers have short operating lives.

Other known coolers are described in U.S. Pat. Nos. 3,851,173; 4,090,859; 4,078,389; 3,523,427, and 4,206,609.

In particular, U.S. Pat. No. 3,851,173 discloses an integral sterling cycle refrigerator employing a single piston. The compressor section of this refrigerator is known as a "common module" and is in wide use throughout the armed services. Although this refrigerator is an integral sterling cycle device having only a single piston, an important aspect of this invention is the modification of this common module compressor to utilize it with the dual-split cold finger also disclosed herein. In this way, a dual-split sterling cycle cryocooler can be built using many common parts and with a minimum of retrofitting.

It is therefore a principal object of this invention to provide a miniature cryogenic system which is highly efficient, compact and characterized by low level of microphonics and thermophonics.

Another principal object is to provide such a system operating on a dual split "compound" stirling cycle which has a comparatively long operating life.

A further object of the invention is to provide a cryogenic cooler employing a compressor assembly with two isolated compressors and producing a split-phase relationship of 180 degrees.

A still further object of this invention is a cryocooler using a comrpessor whose pistons are oriented at a right angle to one another, namely the "common module" compressor.

A still further object of the invention is to provide a system having all of the foregoing advantages and which is manufactured of conventional materials in a relatively simple and straightforward way.

SUMMARY OF THE INVENTION

The miniature cryogenic system according to the present invention includes two compressors with two outlets. First and second conduits containing a working fluid are connected to the compressor outlets. The compressors pressurize the working fluid in a split-phase relationship. These conduits are connected to a cryogenic cold finger assembly, including an elongate housing having a cryogenically cooled end and an internal abutment dividing the housing into first and second interior compartments. The first compartment extends from the cooled end to the abutment. A displacer is disposed slidingly within the first compartment for longitudinal reciprocating motion therein and creates a first (or primary) working volume between the cooled end and the displacer and creates a second (or secondary) working volume between the displacer and the abutment.

A first regenerative bed is disposed within the displacer and the housing has a first inlet adapted for providing fluid communication between the first conduit and the first interior compartment. The displacer has first and second port means so as to provide fluid communication through the first regenerative bed between the first inlet and the first working volume. In addition, a second regenerative bed is disposed within the second interior compartment within the housing. The housing also has a second inlet which provides fluid communication through the second regenerative bed between the second conduit and the second working volume. Means are provided to develop transient cushioning overpressures in the first and second working volumes as the displacer reciprocates under the push-pull influence of the split-phase working fluid flow from the compressor so that cooling is effected in the first and second working volumes and slamming is controlled.

The displacer is guided for longitudinal reciprocating motion within the housing by sliding seals. In a preferred embodiment the first conduit is coiled around the exterior of the housing adjacent to the second working volume to effect a precooling of the working fluid carried in the first conduit. In this embodiment the abutment comprises a web extending across the interior of the housing and includes an opening to provide fluid communication between the first and second interior compartments. A plate is provided for securing the second regenerative bed in a fixed location within the second interior compartment, and a heat exchanger is disposed between this plate and this abutment. A preferred heat exchanger includes a plurality of longitudinally-spaced annular discs.

In order to enhance the pneumatic cushioning, a phase shifting plug is disposed on the lower end of the displacer adjacent to the web and located so as to seal the opening in the abutment when the displacer is closely spaced from the web. This plug can be a pad of resilliant material or a spring disposed within a covering that is located and structured to cover the hole in the abutment. By sealing the opening in the web, the phase relationship of the pressures in the working volumes is shifted so as to provide a cushioning effect which decelerates the displacer in a controlled fashion.

In another embodiment the abutment comprises a solid member which extends substantially the length of the second interior compartment, and the second regenerative bed is located between the solid member and the housing. A heat exchanger, including longitudinally spaced-apart discs flanking the second working volume is adapted for securing the second regenerative bed in a fixed location within the second interior compartment. In this embodiment a heat radiation shield is provided for surrounding the housing in a spaced relationship and extending from the cooled end of the housing toward the second working volume. The radiation shield reduces the heat load falling onto the first working volume. The bottom of the displacer functions as its own phase-shifting device. When the displacer moves downward, it gradually closes off the fluid passages between the heat exchanger discs in the second working volume.

BRIEF DESCRIPTION OF THE DRAWING

The invention disclosed herein will be better understood with reference to the following figures of the drawing of which.

DESCRIPTION OF THE PREFERRED EMBODIMENTS

Figure 1:
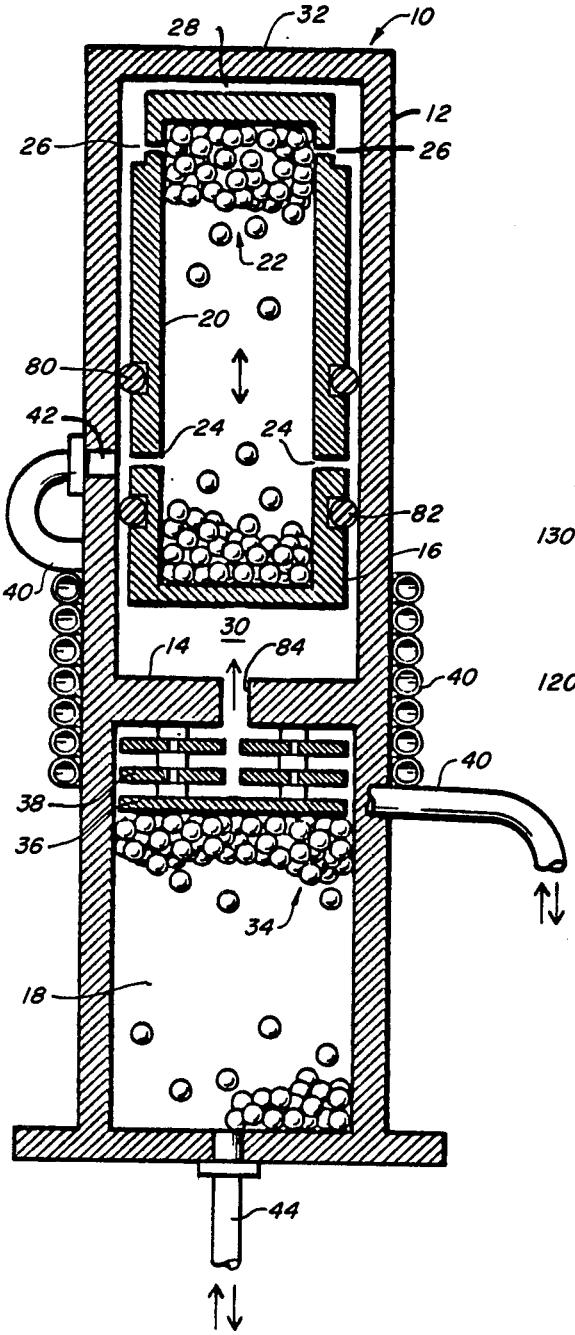
FIG. 1 is a vertical sectional view of a cold finger assembly according to this invention suitable for operation in a dual split "compound" stirling cycle.

The same reference numerals will be used to identify like components in the various figures of the drawing.

With reference first to FIG. 1, shown is a cold finger assembly 10, including a housing 12 made of a material having a low thermal conductivity such as stainless steel. Disposed within the housing 12 is an abutment 14 which divides the interior of the housing 12 into two interior compartments 16 and 18. The compartment 16 has a substantially circular, cylindrical cross section. A displacer 20 is adapted for reciprocating longitudinal motion within the compartment 16. The displacer 20 is formed of a material such as nylon.

The displacer 20 is hollow and contains a first bed of regenerative material 22 comprising, for example, copper screens or copper spheres. The displacer 20 also includes entrance ports 24 which can be seen more clearly with reference to FIGS. 6 and 7. Exit ports 26 are also provided in the upper end of the displacer 20. The displacer 20 has a length which is shorter than the length of the interior compartment 16 so that the displacer 20 creates within the interior compartment 16 a first (or primary) working volume 28 and a second (or secondary) working volume 30 in a working fluid to be described hereinafter. As will become clear, the working volume 28 effects a cooling to cryogenic temperatures of the cold end 32 of the housing 12. The cold end 32 may be made of a material having a very high thermal conductivity such as copper for more effective heat transfer from a thermal load (e.g., an infrared detector) in contact with the cold end 32.

A second bed of regenerative material 34 is included within the interior compartment 18 and held in place by a plate 36. The plate 36 is preferably made of a material having high thermal conductivity such as copper. A series of longitudinally spaced-apart discs 38 are located between the plate 36 and the abutment 14 and are made of a material having a high thermal conductivity so as to serve as an effective heat exchanger.

A first conduit 40 encircles the housing 12 adjacent to the second working volume 30 and communicates with the interior compartment 16 at its terminal end 42. A second conduit 44 communicates with the interior compartment 18.

Figure 2:
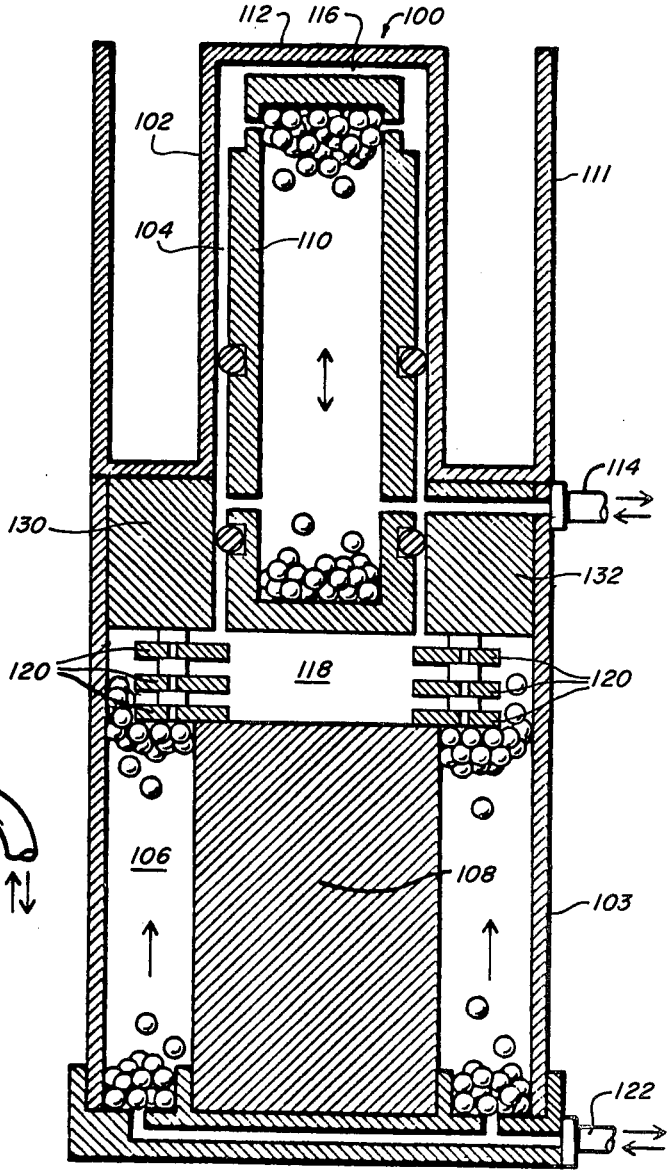
FIG. 2 is a cross-sectional view of another embodiment of such a cold finger.
Figure 3:
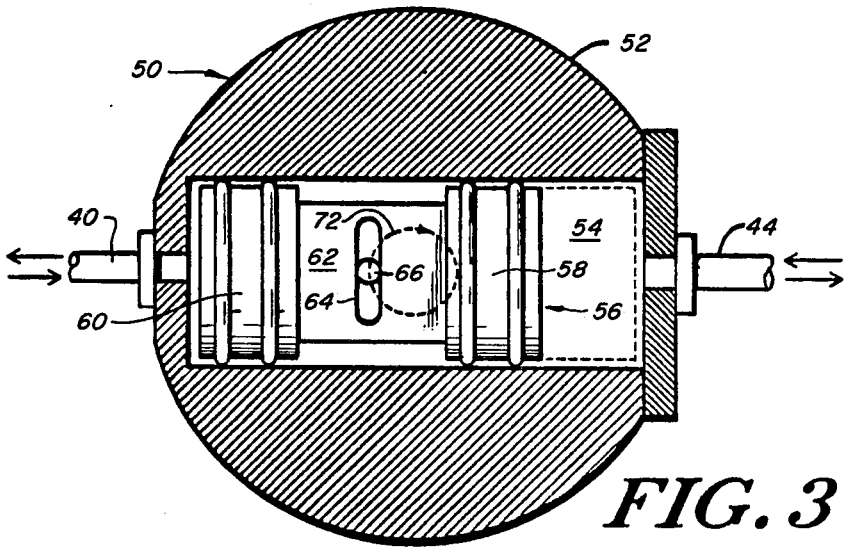
FIG. 3 is a top plan view in partial horizontal section of a compressor suited for use with the cold fingers of FIGS. 1 and 2.
Figure 4:
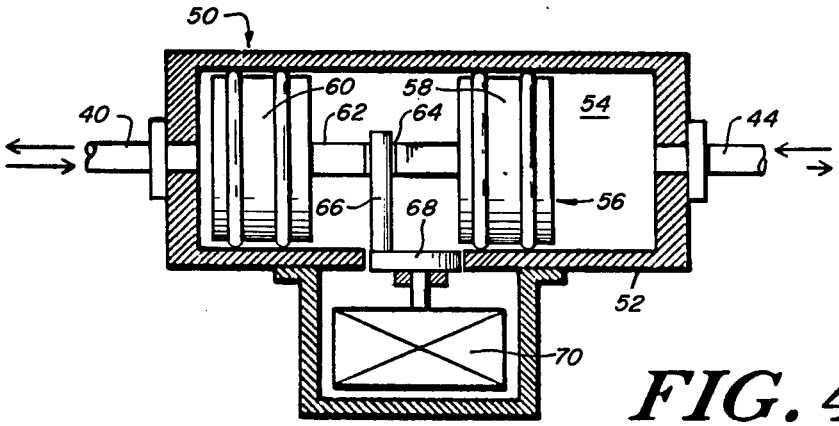
FIG. 4 is a side elevational view in partial section of the compressor.
Figure 5:
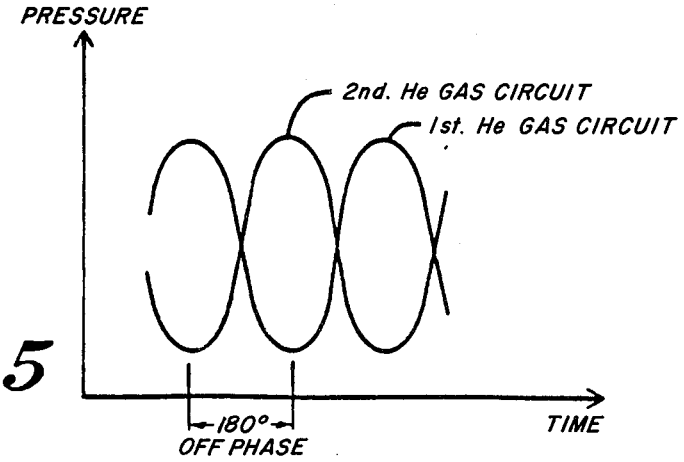
FIG. 5 is a pressure versus time diagram of the pressure waves produced by the compressor.

Referring now to FIGS. 1, 2, 3, and 4, a compressor assembly 50 includes a structural housing 52 with a circular cylindrical cavity 54 therein. A piston assembly 56 includes longitudinally spaced-apart and mutually isolated pistons 58 and 60 which are rigidly connected to one another by connecting member 62. The connecting member 62 includes a slot 64 which engages a pin 66. The pin 66 is eccentrically mounted on a disc 68 driven by a motor 70. As the disc 68 rotates, the pin 66 follows the circular path indicated by the dotted circle 72. Thus, as the pin 66 traverses the circular path 72, the piston assembly 66 will reciprocate longitudinally within the cavity 54. As will be understood by those skilled in the art, when a working fluid such as helium is introduced into the cavity 54, the pressure of the working fluid will alternately increase and decrease as the piston assembly 56 reciprocates. Furthermore, as shown in FIG. 5, the pressure variations in the conduits 40 and 44 will be 180 degrees out of phase, since the pistons 58 and 60 are rigidly linked together. Thus, when the piston assembly 56 is in the position as shown in FIG. 3, the pressure in conduit 40 will be relatively high and the pressure 44 will be relatively low. This relationship reverses as the piston assembly 56 moves toward the right.

The compressor assembly 50 disclosed herein is particularly well adapted for use with a cryogenic cooler. Because the pistons 58 and 60 are of the same diameter and mass, they are balanced about the drive point so that mechanical vibration is minimized. In addition, the "scotch yoke" design with its short moment arm and the linear motion of the piston assembly 56 result in low seal wear and hence long operating life. Furthermore, the prior art did not recognize the desirability or possibility of using a 180° opposed compressor in which the pistons were of the same size. This is the case because the prior art did not conceive of the phase-shifting arrangement disclosed herein which provides pneumatic cushioning for controllably decelerating the displacer so as to decrease slamming. This design results in a compressor which is very compact and one which is simple to fabricate.

The operation of the compressor assembly 50 in conjunction with the cold finger 10 will now be described. As stated above, as the piston assembly 56 reciprocates, pressure waves are created in the conduits 40 and 44, which are 180 degrees out of phase with one another. The working fluid in the conduit 40 such as helium circulates around the exterior of the housing 12 and enters the first interior compartment 16 at the end 42 of the conduit 40. Because of the arrangement of sliding seals 80 and 82 which guide the motion of the displacer 20, the working fluid which enters the interior compartment 16 passes into the interior of the displacer 20 through the ports 24 and travels through the regenerative bed 22 and finally through the ports 26 into the first working volume 28. Similarly, the working fluid in the conduit 44 enters the second interior compartment 18, passes through the second regenerative bed 34 past the plate 36 and the heat exchanger discs 38 and from there into interior compartment 16 through an opening 84 in the abutment 14 to create the working volume 30. Because of the seals 80 and 82, the working volumes 28 and 30 with their working fluid remain separated and isolated from one another.

As the compressor assembly 50 operates, the pressure in working volume 28 is relatively high when the pressure in the working volume 30 is relatively lower and vice versa in a cyclical manner. Because of this cyclically varying pressure differential, the displacer 20 reciprocates within the first interior compartment 16. As is understood by those skilled in the thermodynamic art, as the displacer 20 reciprocates in a cyclical fashion, temperatures within both of the working volumes 28 and 30 decrease. That is, the energy expended results in cooling by the same means as in the well known thermodynamic stirling cycle.

Figure 9:
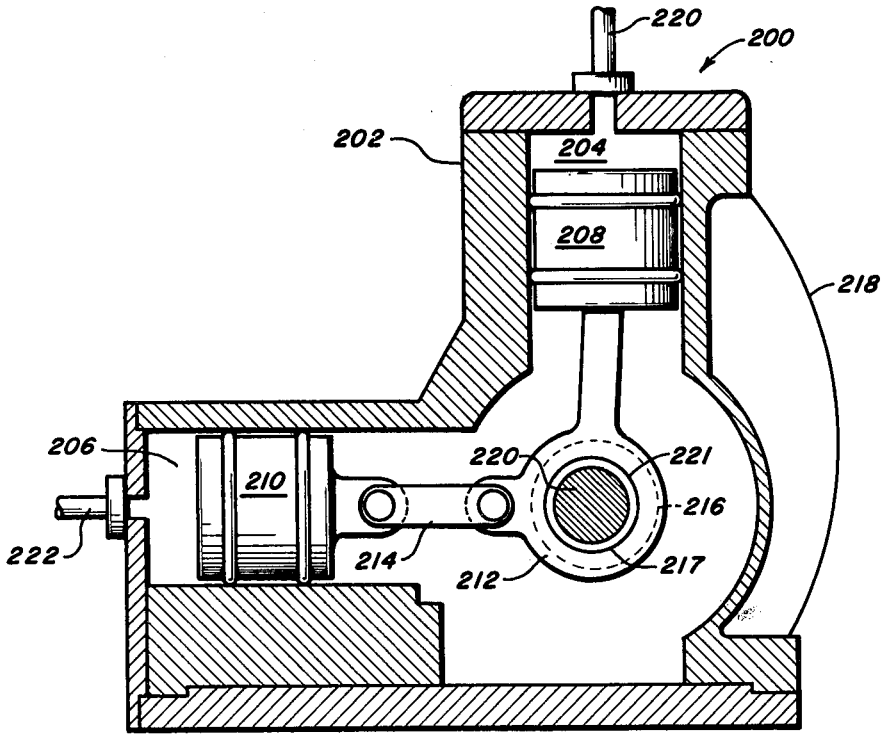
FIG. 9 is a side elevational view in cross section of a compressor suited for use with the cold finger.

Another compressor particularly well suited for use with the cold finger disclosed herein is illustrated in FIG. 9. A compressor 200 includes a housing 202 having cavities 204 and 206 disposed therein. The axes of these cavities 204 and 206 are at a right angle to one another. Pistons 208 and 210 are disposed within the cavities 204 and 206 respectively. A cranking member 212 is adapted for reciprocating both pistons 208 and 210. The cranking member 212 is connected to the piston 210 by the member 214. A shaft 216 of a motor 218 supports an eccentric element 220. The eccentric element 220 is in sliding contact with a circular opening 221 in the cranking member 212. As the shaft 216 rotates, the eccentric element 220 will cause the cranking member 212 to follow a path which causes the pistons 208 and 210 to reciprocate. In this way, split phase pressure waves are generated in the conduits 220 and 222 which are adapted for connection to the cold fingers disclosed herein.

The compressor of FIG. 9 is conveniently made as a modification of an integral stirling cycle refrigerator described in U.S. Pat. No. 3,851,173, the teachings of which are incorporated herein by reference. The compressor illustrated in FIG. 9 herein is therefore a modification of the "common module" compressor illustrated in FIG. 3 of the referenced patent. In particular, the compressor shown in FIG. 9 is made by removing the cold finger section of the refrigerator in the referenced patent and replacing it with the piston 210 shown in FIG. 9 and discussed hereinbefore. In this way, the refrigerator taught in the referenced patent can be used in a dual-split stirling cycle with the cold fingers disclosed herein. By using the existing components with the modification described above, a compressor unit can be made relatively less expensively than by designing and building a compressor unit from scratch.

With reference again to FIG. 1, cooling in both working volumes 28 and 30 is advantageous for two reasons. First, because the conduit 40 encircles the housing 12 adjacent to the working volume 30, cooling in the working volume 30 will cool the working fluid in the conduit 40 before it enters the interior compartment 16. Thus, when the working fluid reaches the working volume 28, it is in a precooled condition so that the overall cooling capability of the cold finger 10 is improved. Second, the thermal gradient across the longitudinal length of the displacer 20 is reduced. Such a reduction in the thermal gradient ameliorates thermophonics.

A significant aspect of the present invention is that the cold finger structure, in combination with the split phase pressure waves applied to the inlets provides for pneumatic cushioning of the displacer so that physical contact between the displacer and the cold end 32 and the abutment 14 is eliminated or controlled. An important factor producing this cushioning is the fluid flow impedances through the regenerative beds 22 and 34. That is, because of the nature of the flow paths, as the displacer rapidly approaches the end 32, for example, pressure builds up in the working volume 28 so as to slow and cushion the displacer before it comes into contact with the end 32. This effect is enhanced by the lateral location of the ports 26 unlike an end location as taught in the prior art. The lateral location also improves the heat transfer characteristics at the cold end 32.

Figure 6:
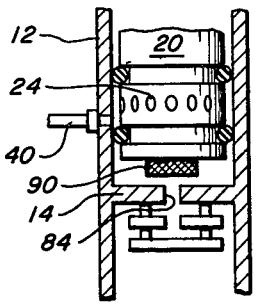
FIG. 6 is a side elevational view in partial vertical cross section of a displacer with an embodiment of a phase shifting device disclosed herein.
Figure 7:
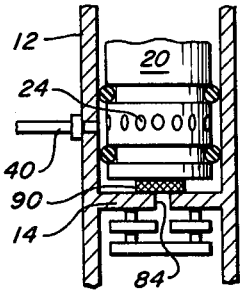
FIG. 7 is a side elevational view in partial vertical cross section of the displacer with an embodiment of a phase shifting device disclosed herein.
Figure 8:
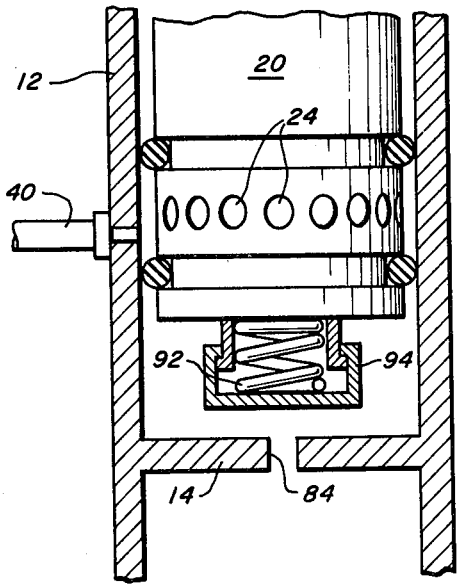
FIG. 8 is a side elevational view in partial cross section showing an alternate embodiment of a phase shifting plug for use with the displacer.

The important embodiment illustrated in FIG. 6 and 7 enhance this pneumatic cushioning effect. A phase shifting plug 90 of a resiliant material is disposed on the lower surface of the displacer 20. As the displacer 20 moves downwardly, the plug 90 covers the opening 84 sealing off the working volume 30 thereby enhancing the transient pressure buildup so as to decelerate the displacer 20. By sealing the opening 84, the phase relationship of the pressures in the two working volumes has thus been shifted from the basic phase relationship defined by the two compressors. FIG. 8 illustrates yet another embodiment adapted for providing enhanced pneumatic cushioning. In this embodiment a spring 92 is attached to the lower surface of the displacer 20 and covered by a metallic material 94. As with the embodiment of FIG. 6 and 7, when the material 94 reaches the abutment 14, the opening 84 is sealed off so as to enhance the buildup of pressure. The spring 92 restores the covering to substantially the same position with each cycle.

Yet another embodiment of a cold finger assembly 100 adapted for operation with the compressor assembly 50 of FIG. 3 or the compressor 200 of FIG. 9 is shown in FIG. 2. In this embodiment a housing including sections 102 and 103 is separated into interior compartments 104 and 106 by a solid abutment 108. The displacer 110 is adapted for reciprocal movement within the interior compartment 104. As in the embodiment of FIG. 1, the displacer 110 is hollow and filled with a bed of regenerative material such as small copper spheres. Likewise the annular region between the housing section 103 and the solid abutment 108 is also filled with a bed of regenerative material. Also included in this embodiment is a heat radiation shield 111 which surrounds the housing section 102 from the cold end 112 to a fluid inlet 114. The radiation shield 111 is made of a highly thermally conductive material such as copper and is effective in keeping radiant energy away from the cooled end 112. As in the embodiment of FIG. 1, two working volumes 116 and 118 are created within the housing 102. Also as in the case of the embodiment of FIG. 1, longitudinally spaced-apart circular discs 120 are provided to enhance heat transfer. A second inlet 122 communicates with the interior compartment 106. The inlets 114 and 122 are connected to a compressor such as the compressor assembly 50 illustrated in FIG. 3. It will thus be appreciated that the displacer 110 will reciprocate in the internal compartment 104 under the influence of "push-pull" pressure waves from the compressor assembly 50. Such reciprocation causes cooling both in the primary working volume 116 and in the secondary working volume 118.

Disposed adjacent to the working volume 118 and in a heat exchange relation with the discs 120 are thermally conductive masses 130 and 132. A suitable material is copper. As the working volume 118 is cooled, the cooling effect is transmitted through the thermally conductive material 130 and 132 so as to effect a precooling of the working fluid coming into the interior compartment 104 through the inlet 114. As discussed with the earlier embodiment, this arrangement not only effects a precooling of the working fluid but also substantially reduces the thermal gradient across the length of the displacer 110 which is effective to control unwanted thermophonics. Thus, because of the thermally conducting material 130 and 132, it is unnecessary that the inlet 114 be coiled around the outside of the assembly 100.

A significant aspect of the embodiment of FIG. 2 is that as the displacer travels downwardly, it sequentially comes abreast of the discs 120. Because of the close tolerance between these discs and the displacer 110, the fluid flow path is progressively reduced as each of the discs is encountered. When the displacer reaches the lowermost disc, the flow is completely cut off. This progressive diminution of flow thus provides for the controlled deceleration of the displacer by way of pneumatic cushioning. In this way, slamming is effectively controlled by this phase shifting means.

It is thus seen that the objects of this invention have been achieved in that there has been disclosed a miniature cryogenic cooling system which has the very desirable characteristics of low microphonics and low thermophonics. These attributes are accomplished because the cold finger employs a pneumatic system to cushion the contact between the reciprocating displacer and its enclosure. In addition, precooling of the working fluid in a second working volume reduces thermal gradients which substantially ameliorate the problem of thermophonics. The two compressors of the compressor assembly which drive the reciprocating displacer are of a simple construction. The compressor which is modified from the refrigerator disclosed in U.S. Pat. No. 3,851,173 is also well suited for use with the cold fingers disclosed herein.

While this invention has been described with reference to its preferred embodiments, it should be understood that variations and modifications will occur to those skilled in the art in view of the foregoing description. It is intended that all such variations and modifications be included within the scope of the appended claims.

What is claimed is:

1. In a miniature cryogenic system having two compressors with two outlets, first and second conduits carrying a working fluid, each conduit connected to one of the outlets, said working fluid pressurized in a split-phase relationship by said compressors, wherein the improvement comprises a cold finger assembly including:

an elongate housing having a cryogenically cooled end and an internal abutment dividing said housing into first and second interior compartments, said first compartment extending from said cooled end to said abutment;

a displacer disposed slidingly within said first compartment for longitudinal reciprocating motion therein and creating a first working volume between said cooled end and said displacer and creating a second working volume between said displacer and said abutment;

a first regenerative bed disposed within said displacer;

a first inlet means located in said housing adapted for providing fluid communication between said first conduit and said first interior compartment;

first and second port means in said displacer providing fluid communication through said first regenerative bed between said first inlet means and said first working volume;

a second regenerative bed disposed within said second interior compartment;

a second inlet means in said housing providing fluid communication through said second regenerative bed between said second conduit means and said second working volume; and means to develop transient cushioning overpressures in said first and second working volumes as said displacer reciprocates alternately toward said cooled end and toward said abutment under the push-pull influence of said split-phase working fluid flow from said compressors whereby cooling is effected in said first and in said second working volumes; and wherein said compressors comprise a single housing including first and second cylindrical cavities disposed therein, the axes of said first and second cavities oriented at a right angle to one another, first and second pistons disposed for reciprocating motion within said first and second cavities respectively; and motor means for reciprocating said pistons to generate said split phase working fluid flow.

2. The system of claim 1 further including sliding seal means disposed between said housing and said displacer to guide said displacer for longitudinal reciprocating motion within said first interior, compartment.

3. The system of claim 2 wherein said sliding seal means comprises a set of resilient sealing members disposed on opposite sides of said first port means in said displacer to block substantially any fluid flow past said sealing means.

4. The system of claim 1 wherein said first conduit is coiled around the exterior of said housing adjacent said second working volume to effect a precooling of the working fluid carried in said first conduit.

5. The system of claim 1 wherein said abutment comprises a web extending across the interior of said housing and includes an opening to provide fluid communication between said first and second interior compartments.

6. The system of claim 5 further including phase-shifting plug means disposed on the lower end of said displacer adjacent to said web and located to seal said opening when said displacer is closely spaced from said web.

7. The system of claim 6 wherein said plug means comprises a pad of resilient material.

8. The system of claim 6 wherein said plug means comprises a spring disposed within a covering.

9. The system of claim 1 further including plate means for securing said second regenerative bed in a fixed location within said second interior compartment and heat exchanger means disposed between said plate and said abutment.

10. The system of claim 9 wherein said heat exchanger means comprises a plurality of longitudinally spaced annular discs.

11. The system of claim 1 wherein said abutment comprises a solid member that extends substantially the length of said second interior compartment and said second regenerative bed is located between said solid member and said housing.

12. The system of claim 11 further including heat exchanger means adapted for securing said second regenerative bed in a fixed location within said second interior compartment.

13. The system of claim 12 wherein said heat exchanger means comprises longitudinally spaced discs flanking said second working volume.

14. The system of claim 13 wherein said longitudinally spaced discs cooperate with said displacer to restrict the flow of said working fluid progressively as said displacer comes abreast of said discs sequentially as it approaches the bottom of its travel.

15. The system of claim 1 further comprising a radiation shield surrounding said housing in a spaced relationship and extending from said cooled end toward said second working volume.

* * * * *